US007000397B2

(12) United States Patent
Pidcock et al.

(10) Patent No.: US 7,000,397 B2
(45) Date of Patent: Feb. 21, 2006

(54) COMBUSTION APPARATUS

(75) Inventors: Anthony Pidcock, Derby (GB); Desmond Close, Derby (GB); Michael P Spooner, Derby (GB)

(73) Assignee: Rolls-Royce plc, London (GB)

( * ) Notice: Subject to any disclaimer, the term of this patent is extended or adjusted under 35 U.S.C. 154(b) by 0 days.

(21) Appl. No.: 11/020,167

(22) Filed: Dec. 27, 2004

(65) Prior Publication Data

US 2005/0262846 A1 Dec. 1, 2005

Related U.S. Application Data

(62) Division of application No. 10/688,875, filed on Oct. 21, 2003, now Pat. No. 6,857,275, which is a division of application No. 10/079,403, filed on Feb. 22, 2002, now Pat. No. 6,708,499.

(30) Foreign Application Priority Data

Mar. 12, 2001 (GB) ..... 0105931

(51) Int. Cl.
*F23R 3/04* (2006.01)

(52) U.S. Cl. ..... 60/752

(58) Field of Classification Search ..... 60/752, 60/754, 755, 759, 796; 29/890.02
See application file for complete search history.

(56) References Cited

U.S. PATENT DOCUMENTS 4,628,694 A * 12/1986 Kelm et al. ..... 60/752
4,695,247 A * 9/1987 Enzaki et al. ..... 60/754
5,687,572 A * 11/1997 Schrantz et al. ..... 60/752

FOREIGN PATENT DOCUMENTS

EP 0 937 946 A2 * 8/1999

* cited by examiner

*Primary Examiner*—Louis J. Casaregola
(74) *Attorney, Agent, or Firm*—W. Warren Taltavull; Manelli Denison & Selter PLLC

(57) ABSTRACT

A wall element for use as part of an inner wall of a gas turbine engine combustor wall structure is of cast construction and includes a plurality of cooling apertures provided therethrough and formed during the casting process. The cooling apertures may be located in positions where they could not be conventionally formed by laser drilling.

5 Claims, 4 Drawing Sheets

COMBUSTION APPARATUS

This is a division of U.S. application Ser. No. 10/688,875 filed Oct. 21, 2003 now U.S. Pat. No. 6,875,275 which itself is a division of U.S. application Ser. No. 10/079,403, filed Feb. 22, 2002, now U.S. Pat. No. 6,708,499.

FIELD OF THE INVENTION

The invention relates to a combustion apparatus for a gas turbine engine. More particularly the invention relates to a wall structure for such a combustion apparatus.

BACKGROUND OF THE INVENTION

A typical gas turbine engine combustor includes a generally annular chamber having a plurality of fuel injectors at an upstream head end. Combustion air is provided through the head and in addition through primary and intermediate mixing ports provided in the combustor walls, downstream of the fuel injectors.

In order to improve the thrust and fuel consumption of gas turbine engines, i.e. the thermal efficiency, it is necessary to use high compressor pressures and combustion temperatures. Higher compressor pressures give rise to higher compressor outlet temperatures and higher pressures in the combustion chamber, which result in the combustor chamber experiencing much higher temperatures than are present in most conventional prior combustor designs.

There is therefore a need to provide effective cooling of the combustion chamber walls. Various cooling methods have been proposed including the provision of a doubled walled combustion chamber whereby cooling air is directed into a gap between spaced outer and inner walls, thus cooling the inner wall. This air is then exhausted into the combustion chamber through apertures in the inner wall. The inner wall may comprise a number of heat resistant tiles, such a construction being relatively simple and inexpensive.

Combustion chamber walls which comprise two or more layers are advantageous in that they only require a relatively small flow of air to achieve adequate cooling. However they are prone to some problems. These include the formation of hot spots in certain areas of the combustion chamber wall. Prior art proposals to alleviate this problem include the provision of raised lands or pedestals on the cold side of the wall tiles, these lands or pedestals serve to increase the surface area of the wall element thus increasing the cooling effect of the air flow between the combustor walls. Compressor delivery air is convected between pedestals on the 'cold face' of the tile and emerges as a film directed along the 'hot' surface of the following downstream tile.

The provision of such lands is also accompanied by inherent problems. For example localised overheating may occur behind obstructions such as mixing ports or adjacent to regions of near stochiometric combustion conditions (hot streaks). A particularly hot region has been recently identified on the combustor wall immediately downstream of the fuel injectors. There is no provision for enhanced heat removal, either locally to remove hot spots or to alleviate more general overheating towards the downstream end of the tile. Overheating may occur downstream of the mixing ports since the protective wall cooling film is stripped away by the transverse mixing jets. Where design requirements have dictated a relatively long tile the cooling film quality towards the downstream edge of the tile may be poor and may lead to local overheating.

To alleviate the above problems, it is known to provide a low conductivity thermal barrier coating on the hot side of the tiles and/or to provide effusion holes within the tiles, to effect localised cooling. Such effusion holes are preferably angled, as this provides an increased cooling surface, and helps to lay down a cooling film on the hot side of the tile. The effusion holes are typically formed by laser drilling.

SUMMARY OF THE INVENTION

According to the invention there is provided a wall element for use as part of an inner wall of a gas turbine engine combustor wall structure, the wall element including inner and outer walls defining a space therebetween, the wall element being of cast construction and including a plurality of cooling apertures provided therethrough and formed during the casting process.

Preferably the wall structure is for a combustor arranged to have a general direction of fluid flow therethrough, and the apertures lie in use at an angle of between 10° and 40° to that general direction of fluid flow.

Preferably the element includes a plurality of projections, which in use extend into the space between the inner and outer walls. An axis of at least one cooling aperture may lie on a line, which intersects at least one of the projections.

Preferably the wall element comprises a thickened portion, the thickened portion includes the plurality of cooling apertures.

Preferably the thickened portion defines a crescent shape.

The wall element may include one or more generally cylindrical projecting studs, the studs are provided for use in fixing the wall element to the outer wall of the wall structure, and at least one cooling aperture provided in or near a base region of a stud.

Alternatively or additionally, the wall element may include at least one integrally formed boss for a mixing port, and at least one cooling aperture provided in or near a base region of the boss.

A base region of a stud or of a mixing port boss may be extended to provide an integral land in which a cooling aperture is located.

According to the invention, there is further provided a wall element for use as part of an inner wall of a gas turbine engine combustor wall structure including inner and outer walls defining a space therebetween, the wall element including a plurality of projections, each projection in use extends into the space between the inner and outer walls and the plurality of cooling apertures extend through the wall element, wherein an axis of at least one aperture lies on a line which intersects at least one projection.

According to the invention, there is further provided a wall element for use as part of an inner wall of a gas turbine engine combustor wall structure including inner and outer walls defining a space therebetween, the wall element including one or more generally cylindrical projecting studs, the studs are provided for use in fixing the wall element to an outer wall of the wall structure, wherein a base region of the stud is extended to provide an integral land in which a cooling aperture is located.

According to the invention, there is further provided a wall element for use as part of an inner wall of a gas turbine engine combustor wall structure including inner and outer walls defining a space therebetween, the wall element including at least one integrally formed boss for a mixing port, wherein a base region of the mixing port boss is extended to provide an integral land in which a cooling aperture is located.

The cooling aperture may be laser drilled.

According to the invention, there is also provided a wall structure for a combustor, the wall structure including inner and outer walls defining a space therebetween and the inner wall including a number of wall elements, one or more of the wall elements being as defined in any of the preceding paragraphs.

According to the invention, there is also provided a gas turbine engine combustion chamber including a wall structure as defined in the preceding paragraph.

According to the invention there is also provided a method of manufacturing a wall element for use as part of an inner wall of a gas turbine engine combustor wall structure including inner and outer walls defining a space therebetween, wherein the method includes the step of casting a plurality of cooling apertures in the wall element.

The method may include the step of investment casting the wall element. The method may include the steps of providing one or more sprues within a working pattern of the wall element to be cast, and subsequently dissolving the sprues out of the cast wall element, thus forming the cooling apertures.

BRIEF DESCRIPTION OF THE DRAWINGS

An embodiment of the invention will be described for the purpose of illustration only with reference to the accompany drawings in which:—

DETAILED DESCRIPTION OF THE INVENTION

Figure 1:
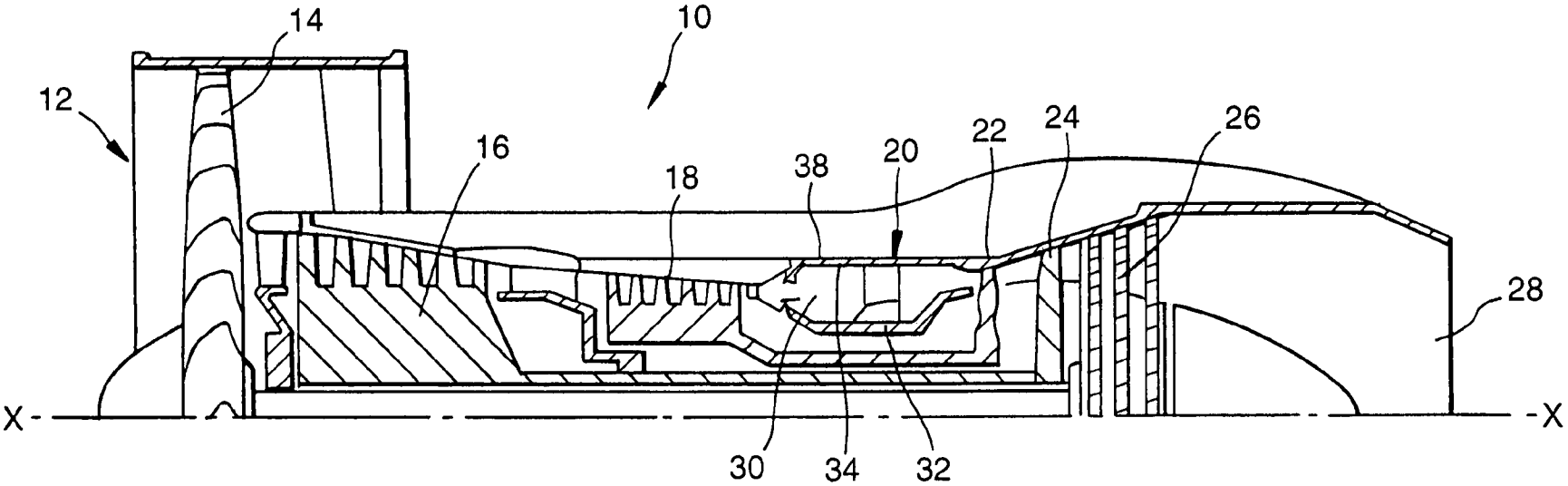
FIG. 1 is a schematic diagram of a ducted fan gas turbine engine having an annular combustor.

With reference to FIG. 1 a ducted fan gas turbine engine generally indicated at 10 comprises, in axial flow series, an air intake 12, a propulsive fan 14, an intermediate pressure compressor 16, a high pressure compressor 18, combustion equipment 20, a high pressure turbine 22, an intermediate pressure turbine 24, a low pressure turbine 26 and an exhaust nozzle 28.

The gas turbine engine 10 works in the conventional manner so that air entering the intake 12 is accelerated by the fan 14 to produce two air flows, a first air flow into the intermediate pressure compressor 16 and a second airflow which provides propulsive thrust. The intermediate pressure compressor 16 compresses the air flow directed into it before delivering the air to the high pressure compressor 18 where further compression takes place.

The compressed air exhausted from the high pressure compressor 18 is directed into the combustion equipment 20 where it is mixed with fuel and the mixture combusted. The resultant hot combustion products then expand through and thereby drive the high, intermediate and low pressure turbines 22, 24 and 26 before being exhausted through the nozzle 28 to provide additional propulsive thrust. The high, intermediate and low pressure turbines 22, 24 and 26 respectively drive the high and intermediate pressure compressors 16 and 18 and the fan 14 by suitable interconnecting shafts.

The combustion equipment 20 includes an annular combustor 30 having radially inner and outer wall structures 32 and 34 respectively. Fuel is directed into the combustor 30 through a number of fuel nozzles (not shown) located at the upstream end of the combustor 30. The fuel nozzles are circumferentially spaced around the engine 10 and serve to spray fuel into air derived from the high pressure compressor 18. The resultant fuel and air mixture is then combusted within the combustor 30.

The combustion process which takes place within the combustor 30 naturally generates a large amount of heat. Temperatures within the combustor may be between 1,850 K and 2,600 K. It is necessary therefore to arrange that the inner and outer wall structures 32 and 34 are capable of withstanding this heat while functioning in a normal manner. The radially outer wall structure 34 can be seen more clearly in FIG. 2.

Figure 2:
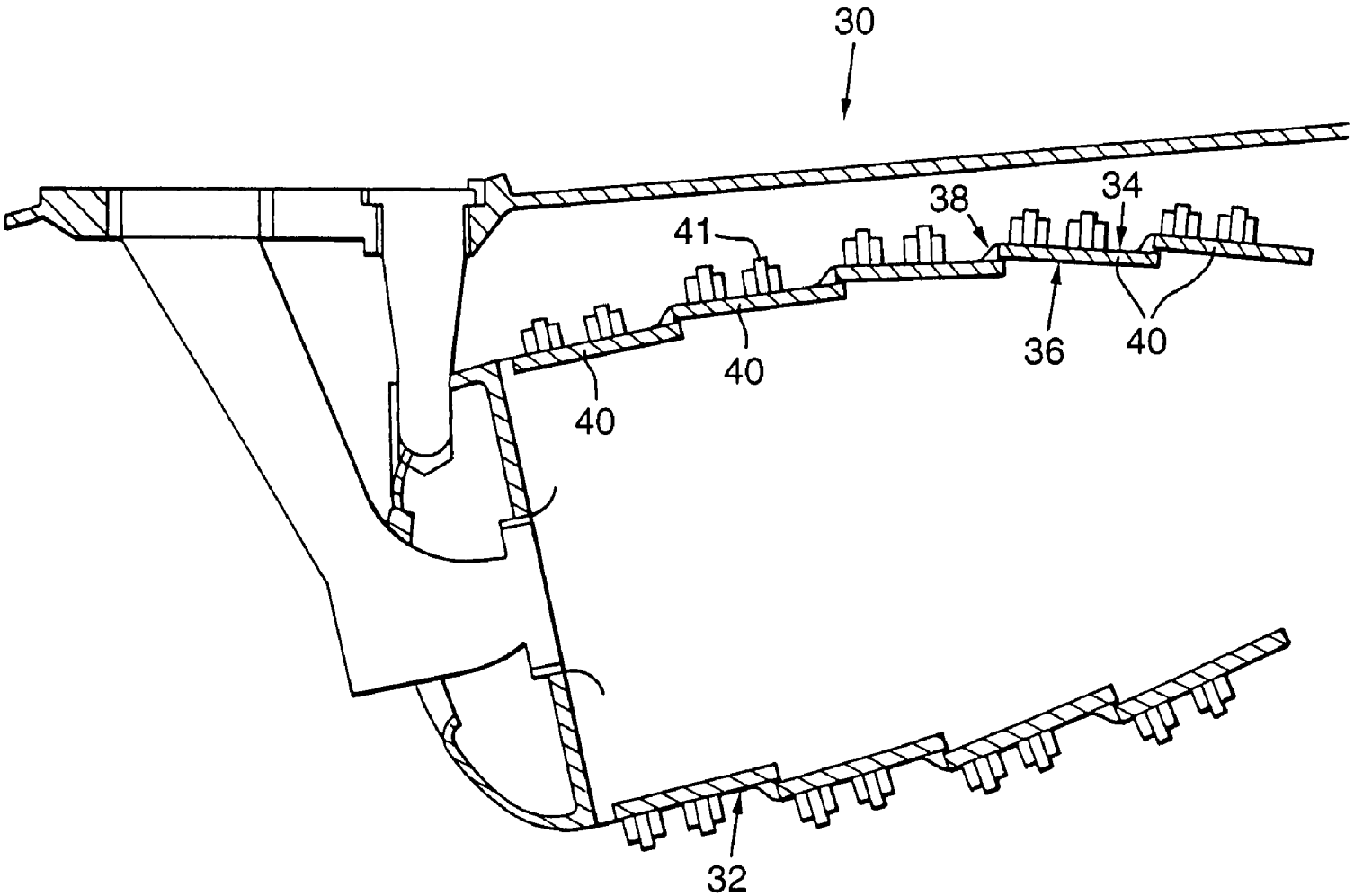
FIG. 2 is a diagrammatic cross section of an annular combustor.

Referring to FIG. 2 the wall structure 34 includes an inner wall 36 and an outer wall 38. The inner wall 36 comprises a plurality of discrete tiles 40 which are all of substantially the same rectangular configuration and are positioned adjacent each other. The majority of the tiles 40 are arranged to be equidistant from the outer wall 38. Each tile 40 is of cast construction and is provided with integral studs 41 which facilitate its attachment to the outer wall 38. Feed holes (not shown in FIG. 2) are provided in the outer wall 38 such that cooling air is allowed to flow into the gap between the tiles 40 and outer wall 38. The temperature of this air is around 800K to 900K and the pressure outside the combustor is about 3% to 5% higher than the pressure inside the combustor (perhaps 600 psi as opposed to 570 psi).

Figure 3:
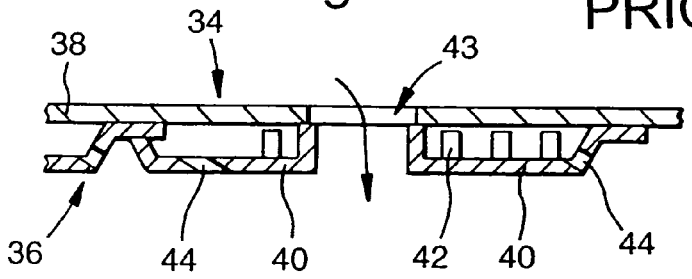
Fig.3. PRIOR ART
FIG. 3 is a diagrammatic detail of part of a prior art combustor wall structure suitable for the gas turbine engine of FIG. 1.

Referring to FIG. 3, each tile 40 also has a plurality of raised pedestals 42 which improve the cooling process by providing additional surface area for the cooling air to flow over.

Air is directed into the combustion chamber 30 through mixing ports 43. The function of the mixing ports 43 is to direct air into the combustion chamber in a manner which achieves optimum mixing with the fuel, in order to help control combustion emissions.

Each tile 40 also incorporates a number of effusion cooling holes 44. The holes 44 are conventionally laser drilled into the tile after the basic shape of the tile has been formed by casting. The holes 44 must therefore conventionally be located such that any pedestals, mixing port bosses, etc., are not in the line of sight of the laser.

Figure 4:
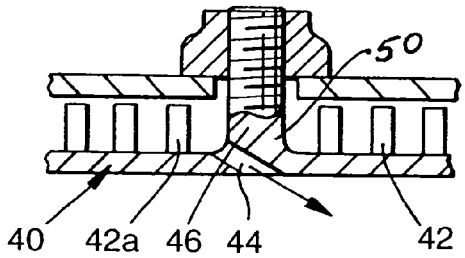
FIG. 4 is a diagrammatic cross section of a combustor wall structure according to a first embodiment of the present invention.

Referring to FIG. 4, a tile 40 according to the invention includes an integrally cast stud 46. The stud 46 is threaded at its distal end and may be used to attach the tile 40 to the outer wall 38 by means of a nut 48. The tile 40 is also provided with a plurality of raised pedestals 42 around which cooling air flows, to improve the cooling of the tile 40.

A cooling hole 44 is provided in a base region 50 of the stud 46. The cooling hole 44 is substantially cylindrical in shape and slopes at an angle of about 30° to 40° to the general plane of the tile 40. This hole 44 is formed during the casting process, in a manner described in more detail hereinafter. As can be seen in FIG. 4, if the hole 44 had been laser drilled, a pedestal 42*a* would have been destroyed because it lies in the line of sight of the laser.

Figure 5:
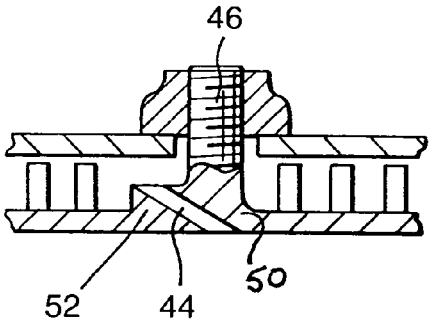
FIG. 5 is a diagrammatic cross section of a combustor wall structure according to a second embodiment of the present invention.

Referring to FIG. 5, according to an alternative embodiment of the invention a tile 40 is provided with an integrally cast stud 46, which is generally similar to the stud of the FIG. 3 embodiment. However, the stud 46 is provided with an extended land 52 at its base region 50. The land 52 is integrally formed with the stud 46.

A cooling hole 44 is provided within the extended land 52. The cooling hole 44 slopes at an angle of about 30° to 40° to the general plane of the tile 40, and is formed during the casting process, as described hereinafter. However, in this case the cooling hole 44 could alternatively be laser drilled because the line of sight of the laser does not pass through any further pedestals, studs, etc.

Figure 6:
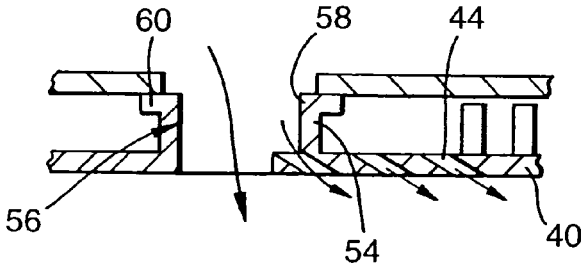
FIG. 6 is a diagrammatic cross section of a combustor wall structure according to a third embodiment of the present invention.

Referring to FIG. 6, a tile 40 is formed with an integral boss 54 of a mixing port 56. The boss 54 consists of a generally cylindrical wall 58 topped by an annular flange 60. The tile 40 is also provided with a plurality of raised pedestals 42, as in the previous embodiments.

The tile 40 of FIG. 6 is provided with a plurality of cooling holes 44, angled at about 30° to 40° to the general plane of the tile 40. The cooling holes 44 are formed during the casting process in positions where, if they were formed by laser drilling, the boss 54 of the mixing port 56 would be destroyed. The cooling film on the inside of a tile 40 tends to be disturbed downstream of the mixing port 56, because of the tendency for flow disturbance and reversals of hot combustion gases. Use of angled cooling holes 44 in the region directly downstream of the mixing port 56 and as close as possible to the mixing port 56 is thus most advantageous in that it allows the cool air film to be restored downstream of the port 56.

Figure 7:
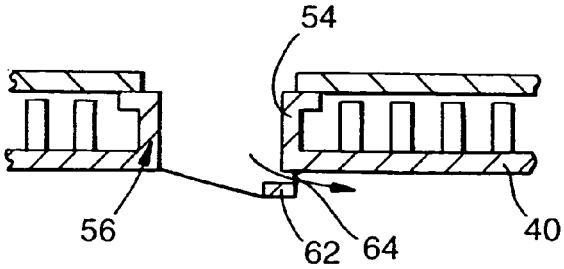
FIG. 7 is a diagrammatic cross section of a combustor wall structure according to a fourth embodiment of the present invention.

Referring to FIG. 7, a boss 54 of a mixing port 56 is again cast integrally with the tile 40. However, in this case the boss 54 of the mixing port 56 includes an extended downstream tip 62 which allows cooling air to pass through as aperture 64 formed during the casting process. The air flows as indicated by the arrow, thus restoring the cool air film protection downstream of the port 56.

The embodiments of FIG. 6 or 7 may include one or more cooling holes cast within the boss 54 as an alternative or in addition to the cooling holes 44, 64 illustrated.

The casting of the cooling holes 44, 64 according to the invention allows cooling holes 44, 46 to be provided in the bases of studs 46 of mixing port bosses 54, 58 and near rows of pedestals 42. According to the prior art, the laser drilling of the cooling holes prevented this from being possible. It is highly advantageous to be able to provide cooling directly downstream of mixing ports 56, since the conventional cooling film breaks down at this point.

Provision of cooling apertures in or near the bases of studs 46 is also highly advantageous, because overheating may occur near the base of the stud 46. Further, the provision of an integral land 52 adjacent to a stud base reinforces the stud 46 to compensate for the weakening of the stud base due to the cooling hole 44.

Conventionally, studs 46 have been provided in the front halves of tiles 40 where the tiles 40 tend to be less hot. Because the invention allows individual cooling holes to be inserted into the bases of studs, it may be possible to provide studs 46 nearer to the rear of the tiles 40.

Figure 8:
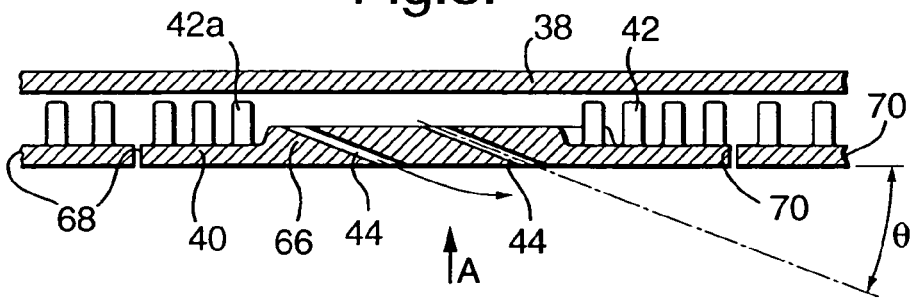
FIG. 8 is a diagrammatic cross section of a combustor wall structure according to a fifth embodiment of the present invention.

FIG. 8 shows a further embodiment of the present invention and specifically shows a tile 40 having a locally thickened portion 66, which comprises effusion cooling holes 44. In keeping with the present invention, the holes 44 are integrally cast. The tile 40 has an upstream end 68 and a downstream end 70 and it is intended to use this embodiment where there is a hot spot on the combustor wall. Such a hot spot can commonly form just downstream of a fuel injector of the combustor 30. It is therefore desirable to provide additional film cooling to alleviate the hot spot.

Typically a tile 40 has a wall thickness of approximately one millimeter and the thickened portion 66 has a preferred thickness of approximately two millimeters. However, these dimensions should not strictly be taken as limitations and it should be understood that the thickened portion 66 may have any thickness greater than an un-thickened portion. The thickened portion 66 is an intrinsic part of this embodiment and has a number of important advantages.

One advantage is that the angle of the effusion cooling holes 44 are formed at an increased angle of incidence to the downstream direction. Although an angle θ is a preferred angle for the cast effusion cooling holes, as shown in the Figure, an angle of between 10° to 20° is also possible as the thickened portion 66 provides an increase in the structural integrity of the tile 40 where an array of effusion cooling holes 44 are placed. For an un-thickened section having an array of effusion cooling holes 44 the amount of material removed inherently leaves a significantly weakened tile wall. This enhances the effectiveness of the cooling film as the cooling film does not impinge into the combustor as far as is the case with conventional cooling holes. It should be noted that the design of a combustor tile 40 is partly driven by providing a lightweight structure and therefore there is a constant desire to reduce the section thicknesses of the tiles 40. Furthermore it has been shown that thin walled tiles 40 are preferable so as to aid the removal of heat therefrom.

A typical laser drilled effusion cooling hole 44 is approximately 0.5 millimeters in diameter whereas cast cooling holes 44 are approximately one millimeter in diameter and therefore have a significantly greater flow area than the conventionally laser drilled holes. The cast cooling holes 44 have both a greater length and a greater wetted perimeter hence they comprise a significant increase in the surface area which is exposed to the cooling air flowing therethrough and thus remove significantly more heat from the tile wall. The increase in the cross sectional area for cooling air flowing through the cooling holes also reduces the velocity of the cooling air, issuing therefrom, which is advantageous in reducing the amount of cooling air which impinges into the combustion gases.

Casting the cooling holes 44 rather than laser drilling them also prevents pedestal 42*a* from being destroyed or partially destroyed during the forming of the hole 44. This is particularly important as the loss of a pedestal upstream of the effusion cooling holes 44 will incur a local increase in tile temperature.

It is also an important aspect of the thickened portion 66 that the length of the cooling holes 44 is increased so that the cooling air passing therethrough is better directed along the main axis of the hole 44. If the cooling holes were placed in an un-thickened region of the tile 40 the cooling air has a tendency to pass substantially radially through the tile 40 and has a greater radial velocity component than the actual angle of the cooling hole 44. The cast cooling holes 44 in the thickened portion 66 therefore substantially improve the effectiveness of the cooling film produced.

A further advantage of these cast cooling holes 44 is that where the tiles 40 are sprayed with a thermal barrier coating (TBC), typically 0.3 millimeters thick, the cast holes 44 are sufficiently large to accommodate the TBC thickness without significant detriment to the generation of the cooling film. Furthermore laser drilled holes are usually formed after spraying the tile with a thermal barrier coating and this can lead to integrity problems with the thermal barrier coating.

Figure 9:
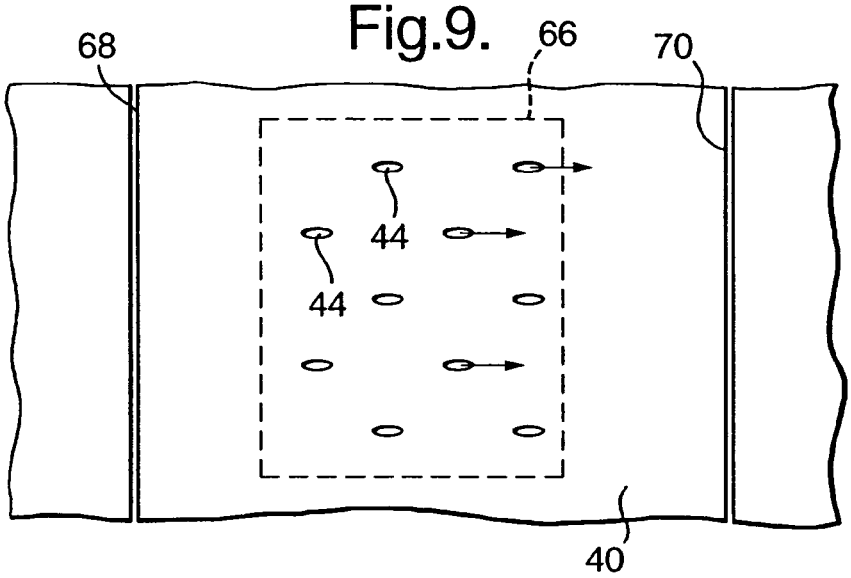
FIG. 9 is a view on arrow A shown in FIG. 8.

FIG. 9 is a view on arrow A and shows a typical pattern for an array of cast cooling holes 44 on a tile 40. Outlined by a dashed line is the extent of the thickened portion 66. It has recently been found that use of this embodiment of the present invention, immediately downstream of the fuel injector, provides a decrease in temperature of a hot spot on the tile 40 of 50–100° C. This effectively removes the hot spot altogether. Removal of the hot spot has further advantages other than reducing the temperature of the tile 40 below the maximum working temperature. The removal of the hot spot means that the tile 40 has a more even temperature throughout, which reduces the thermal stresses and strains associated to a thermal gradient caused by the hot spot. This in turn allows the tile 40 to be designed for greater life and an overall lower temperature. Although the figure shows five rows of cooling holes 44 a single or two rows may be sufficient depending on the level of additional cooling required. The axial and circumferential extent of the thickened portion 66 is dependent on the axial and circumferential extent of the hot spot which requires additional cooling.

Figure 10:
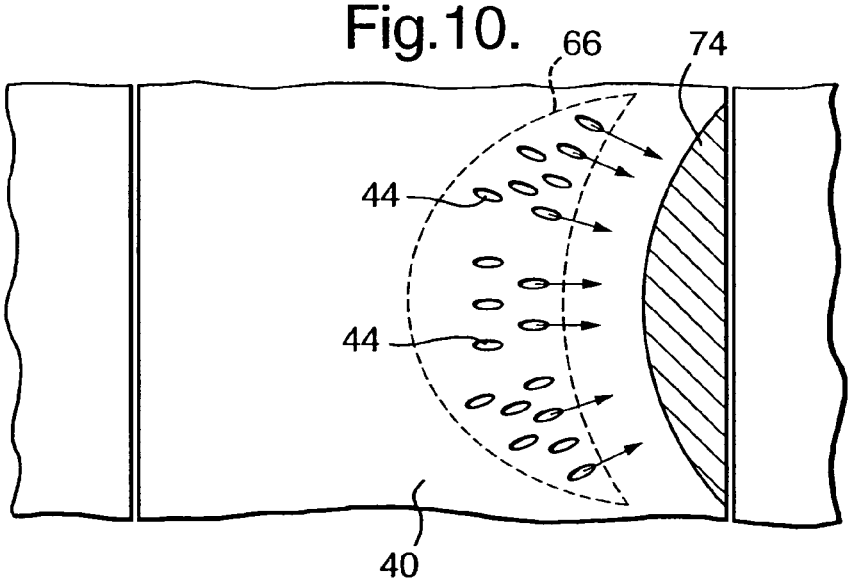
FIG. 10 is a view on arrow A shown in FIG. 8 and shows a preferred pattern for an array of cast cooling holes.

FIG. 10 is a view on arrow A and shows a preferred pattern for an array of cast cooling holes 44 on a tile 40. Outlined by a dashed line is the extent of the thickened portion 66 comprising the plurality of cooling apertures 44. It is envisaged that this crescent shaped thickened portion 66 will form a preferred and optimised embodiment. It is typical for a hot spot 74 to have a generally crescent shape itself thus this embodiment specifically targets the additional cooling requirements of this particular shape of hot spot 74. In so doing the design optimises the use of cooling air and releases more air for mixing with combustion gases. Thus it should be seen that another advantage of the use of a thickened portion 66 is the increased flexibility in the design which is enabled by the use of the casting process. Whereas laser drilled techniques are most cost effective when the holes are parallel and in straight arrays, cooling array designs with cast holes are only limited by the complexity of the tooling.

The tiles 40 according to the invention may be manufactured by "investment" or "lost wax" casting. Typically this involves forming an impression or master mould of the tile from an original pattern and casting from that master mould a working pattern in wax (or a similar material). The working pattern is embedded in a slurry or paste of refractory mould material and the mould is heated, causing the wax to melt and run out. The mould is then baked until it becomes hard and strong. The metal tile is cast in the mould and, once the metal has solidified, the mould is broken up.

The holes 44 may be created by providing ceramic sprues or cores in the mould, and allowing the wax working pattern of the tile to form around the ceramic sprues. Metal for forming the tiles subsequently burns away the wax, leaving the ceramic sprues in place. The ceramic sprues may finally be dissolved out of the cast tile, using a suitable solution, leaving the holes 44.

According to the invention, it is therefore possible to produce tiles with cooling holes in places where they cannot conventionally be located. This allows for the efficient cooling of the tile downstream of studs and mixing ports and in other areas where cooling is necessary but conventionally difficult to effect. There is also no need to limit the number of pedestals provided in regions where cooling holes 44 are necessary.

A tile according to the invention may include some cooling holes which are cast due to the proximity of pedestals, studs, mixing ports or other obstructions, and some cooling holes which are laser drilled.

The use of lands cast integrally with studs, mixing ports, etc., allows holes to be laser drilled in these areas.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

We claim:

1. A wall element for use as part of an inner wall of a gas turbine engine combustor wall structure including inner and outer walls defining a space therebetween, one of said inner and outer walls including a plurality of pedestals projecting therefrom toward the other wall, the wall element including at least one integrally formed boss for a mixing port, said boss having a base region and wherein said base region of the mixing port boss is extended to provide a land integral with the mixing port boss, and wherein a cooling aperture is provided in the land.

2. A wall element according to claim 1 wherein the cooling aperture is laser drilled.

3. A wall element according to claim 1 wherein the land includes an extended downstream tip, the cooling aperture defined by the extended downstream tip.

4. A wall element according to claim 1 wherein the wall element is formed during a casting process.

5. A wall element according to claim 1 wherein the wall structure is for a combustor arranged to have a general direction of fluid flow therethrough, and the cooling apertures lies in use at an angle of between 10° and 40° to the general direction of fluid flow.

* * * * *